US009993041B2

(12) United States Patent
Wibowo

(10) Patent No.: US 9,993,041 B2
(45) Date of Patent: Jun. 12, 2018

(54) METHODS AND APPARATUSES FOR TAPERING ARTIFICIAL EYELASHES

(71) Applicant: Kiss Nail Products, Inc., Port Washington, NY (US)

(72) Inventor: Tri Agus Wibowo, Purbalingga (ID)

(73) Assignee: Kiss Nail Products, Inc., Port Washington, NY (US)

( * ) Notice: Subject to any disclaimer, the term of this patent is extended or adjusted under 35 U.S.C. 154(b) by 0 days. days.

(21) Appl. No.: 14/754,882

(22) Filed: Jun. 30, 2015

(65) Prior Publication Data

US 2017/0000204 A1 Jan. 5, 2017

(51) Int. Cl.
*A41G 5/02* (2006.01)

(52) U.S. Cl.
CPC ..... *A41G 5/02* (2013.01)

(58) Field of Classification Search
CPC ..... D02J 3/02; D02J 1/16; A46D 1/05; A46D 1/06; A46D 9/00; A46D 9/02; A41G 5/00; A41G 5/02
USPC ..... 26/28
See application file for complete search history.

(56) References Cited

U.S. PATENT DOCUMENTS 1,344,777 A * 6/1920 Stroud ..... D06C 29/00 26/2 R
1,350,687 A * 8/1920 Turner ..... A42C 1/08 223/20
3,158,983 A * 12/1964 Tlamicha ..... B65H 57/28 28/220
3,523,346 A * 8/1970 Bolen ..... D06C 11/00 26/28
3,559,657 A * 2/1971 Bau ..... A41G 5/02 132/201
5,205,140 A * 4/1993 Nielsen ..... D04B 35/36 26/28
5,472,263 A * 12/1995 Gerspacher ..... A46B 9/04 300/17
5,791,740 A * 8/1998 Squillaci ..... A46B 3/18 300/21
5,815,896 A * 10/1998 Dischler ..... D06C 11/00 26/17
2002/0007837 A1* 1/2002 Mathiez ..... A46B 3/18 132/218
2004/0240926 A1* 12/2004 Gueret ..... A46B 3/18 401/122

* cited by examiner

*Primary Examiner* — Todd E Manahan
*Assistant Examiner* — Jennifer Gill
(74) *Attorney, Agent, or Firm* — Hunton Andrews Kurth LLP

(57) ABSTRACT

Methods and apparatuses for tapering artificial eyelashes include coupling artificial eyelashes to a first roller, and rotatably engaging at least a portion of the artificial eyelashes with an outer surface of a second roller. In an example, the outer surface of the second roller may include a friction element coupled thereto.

13 Claims, 2 Drawing Sheets

METHODS AND APPARATUSES FOR TAPERING ARTIFICIAL EYELASHES

FIELD OF TECHNOLOGY

The present disclosure relates generally to cosmetic applications, and, more particularly, to methods and apparatuses for tapering artificial eyelashes.

BACKGROUND

As an alternative to or in addition to mascara, eyelash lengthening, darkening or thickening may be accomplished by attaching artificial eyelashes to a user's eyelids to enhance the appearance of eyelashes. In a typical application, the artificial eyelash may be cut to length, if necessary. Such artificial eyelashes are generally secured to the user's eyelids by an adhesive.

SUMMARY

The present disclosure, in part, is directed to methods and apparatuses that address certain of the limitations of conventional approaches for tapering artificial eyelashes. In conventional processes, to mimic the tapering of naturally long eyelashes, artificial eyelashes may be tapered by applying a gradually decreasing amount of chemical to the strands. One non-limiting aspect of the present disclosure is directed to a method of tapering artificial eyelashes, the method including coupling the artificial eyelashes to a first roller, and rotatably engaging at least a portion of the artificial eyelashes with an outer surface of a second roller. In certain non-limiting embodiments, the artificial eyelashes are tapered without applying any chemicals.

Another non-limiting aspect of the present disclosure is directed to an apparatus for tapering artificial eyelashes. The apparatus includes a first roller adapted to receive the eyelashes, and a second roller defines an outer surface that is adapted to rotatably engage at least a portion of the eyelashes.

BRIEF DESCRIPTION OF THE DRAWINGS

The above and other aspects, features and advantages of the present disclosure will be more apparent from the following detailed description when taken in conjunction with the accompanying drawings, in which.

Figure 1:
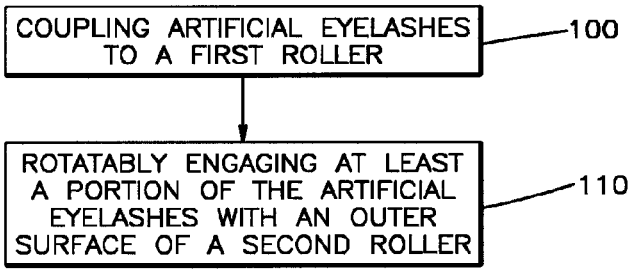
FIG. 1 is a flow chart of a non-limiting embodiment of a method of tapering eyelashes according to the present disclosure.

The reader will appreciate the foregoing details, as well as others, upon considering the following detailed description of certain non-limiting embodiments of methods and apparatuses according to the present disclosure. The reader also may comprehend certain of such additional details upon using the methods and apparatuses described herein.

DETAILED DESCRIPTION

Embodiments of the present disclosure are described in detail with reference to the accompanying drawings. The same or similar components may be designated by the same or similar reference numerals although they are illustrated in different drawings. Detailed descriptions of constructions or processes known in the art may be omitted to avoid obscuring the subject matter of the present disclosure. Further, in the following description of the present disclosure, various specific definitions found in the following description are provided only to provide a general understanding of the present disclosure, and it is apparent to those skilled in the art that the present disclosure can be implemented without such definitions.

The present disclosure, in part, is directed to methods and apparatuses that address certain of the limitations of conventional approaches for tapering artificial eyelashes. Referring to FIG. 1, a non-limiting embodiment of a method of tapering artificial eyelashes is illustrated. The method includes coupling artificial eyelashes to a first roller (block 100), and rotatably engaging at least a portion of the artificial eyelashes with an outer surface of a second roller (block 110).

"Artificial eyelashes" as used herein refers to a device including a plurality of strands that are not part of an individual's body for application to the eyelid. In certain non-limiting embodiments, the strands are coupled to a spine or base strand. In certain other non-limiting embodiments, the strands are not coupled to a spine or base strand, and are applied individually and directly to an individual's eyelashes. The artificial eyelashes can be made from strands that may have been cleaned and dried, by tying the strands to a spine or base strand, trimming the strands to desired lengths, and curling the strands to provide a natural look. When the strands are trimmed to the desired lengths, the strands are typically left with blunt ends, in contrast to the tapered and pointed ends of natural eyelashes. Thus, there has a developed a need for tapering artificial eyelashes to mimic the tapering of naturally long eyelashes.

The methods described herein may be used in connection with strands selected from the group consisting of human hair, animal hair, synthetic fibers and combinations thereof. In conventional processes, artificial eyelashes may be tapered by applying a gradually increasing amount of chemical to synthetic strands, from a proximal end to a distal end. However, human hair, animal hair and certain synthetic fibers may become damaged when exposed to such chemicals. This is particularly true considering that the strands can be delicate and small—between approximately 0.01 mm and approximately 0.40 mm in diameter, and between approximately 2 mm and approximately 30 mm in length. To address certain limitations of conventional approaches for tapering artificial eyelashes, in certain non-limiting embodiments of methods according to the present disclosure, the eyelashes are tapered without applying any chemicals.

Figure 2:
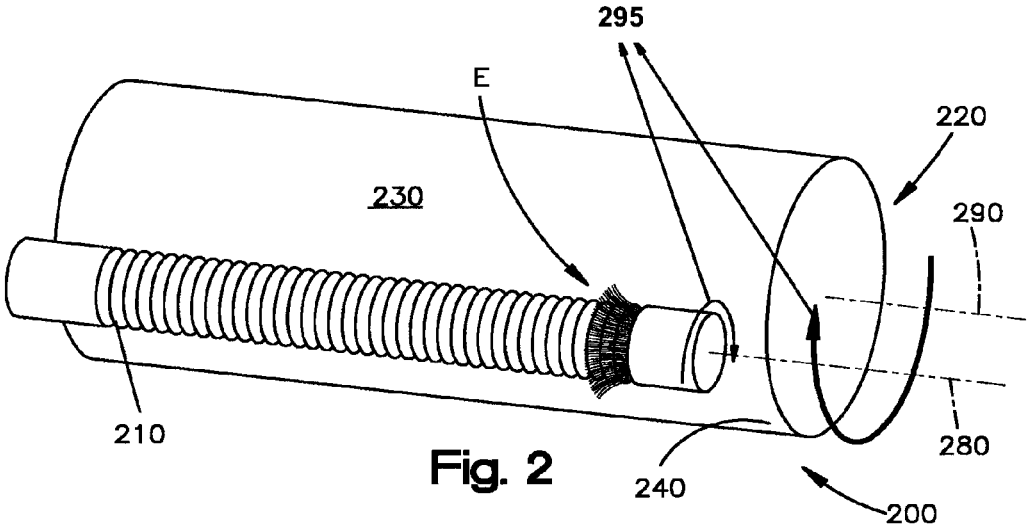
FIG. 2 is a perspective view of an apparatus for tapering artificial eyelashes according to a non-limiting embodiment of the present disclosure.

Referring to FIG. 2, the illustrated embodiment of the apparatus 200 for tapering artificial eyelashes E comprises a first roller 210 adapted to receive the artificial eyelashes E, and a second roller 220 defining an outer surface 230 that is adapted to rotatably engage at least a portion of the artificial eyelashes E. According to certain non-limiting embodiments, a friction element 240 is coupled to the outer surface 230 of the second roller 220. According to certain non-limiting embodiments, the friction element 240 may be formed of sandpaper. Depending on the use requirements or preferences of the particular method or apparatus 200, it may be possible to utilize other elements that provide friction or abrasion. For example, the friction element 240 can be or include particulate materials. According to other embodiments, the friction element 240 can be or include materials with an increased surface roughness or texture.

Figure 3:
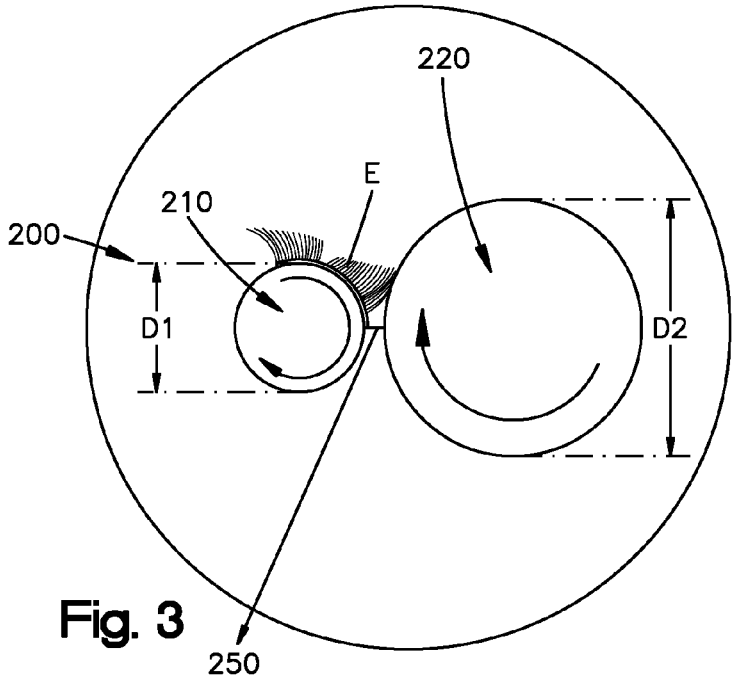
FIG. 3 is a plan view of the apparatus shown in FIG. 2.

Referring also to FIG. 3, according to the illustrated non-limiting embodiment, the second roller 220 is spaced apart from at least a portion of the first roller 210, defining a gap 250 therebetween. A proximal portion 260 of the artificial eyelashes E is disposed on the first roller 210, and a distal portion 270 of the artificial eyelashes E extends into the gap 250 for tapering. According to certain non-limiting embodiments, it may be possible to use any distance between the first and second rollers 210, 220, provided that the eyelashes E can be suitably tapered without being unacceptably cut or broken between the first and second rollers 210, 220. Those having ordinary skill will be able to reasonably derive various possible distances for the gap 250 depending on the desired length of a given eyelash, and any of such designs may be incorporated into methods and apparatuses of the present disclosure. According to certain non-limiting embodiments, the gap 250 between the first and second roller 210, 220 may be adjustable.

According to certain non-limiting embodiments, the first roller 210 defines a first rotational axis 280, the second roller 220 defines a second rotational axis 290, and the first rotational axis 280 is substantially parallel with the second rotational axis 290. Other configurations are possible depending on the usage requirement or preferences for the particular apparatus 200, including configurations where the first roller 210 is angled relative to the adjacent part of the second roller 220. According to the illustrated non-limiting embodiment, the first roller 210 and the second roller 220 are rotated in the same direction in direction of rotation 295. According to certain other non-limiting embodiments, the first roller 210 and the second roller 220 are rotated in opposite directions.

Figure 4:
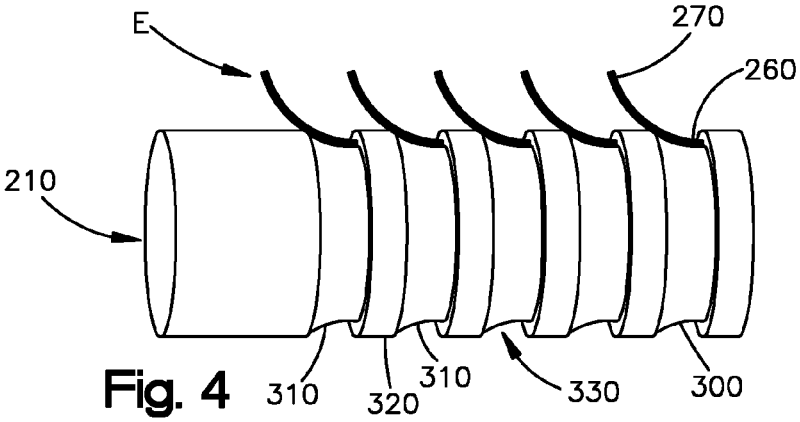
FIG. 4 is an enlarged partial side view of the apparatus shown in FIG. 2, illustrating artificial eyelashes disposed thereon.
Figure 5:
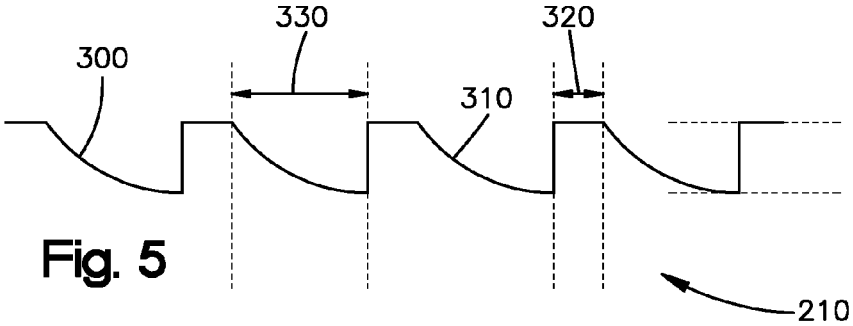
FIG. 5 is an enlarged partial side view of the apparatus shown in FIG. 4.

Referring also to FIGS. 4 to 5, according to the illustrated non-limiting embodiment, the eyelashes E are coupled along a circumferential edge 300 of the first roller 210. Specifically, the first roller 210 comprises at least one arcuate roller surface that has a curvature that curves inward toward a center of the first roller and the at least one arcuate roller surface 310 is adapted to receive the artificial eyelashes E. According to the illustrated non-limiting embodiment, at least two of the arcuate roller surfaces 310 are connected to each other through a mediate cylindrical roller surface 320. Each arcuate roller surface 310 of the first roller 210 defines a reduced diameter portion 330, and the artificial eyelashes E are coupled to the reduced diameter portion 330. This shape of the first roller 210 allows for easier retention of the artificial eyelashes E for the tapering process.

According to certain non-limiting embodiments, the first roller 210 has a first diameter D1, the second roller 220 has a second diameter D2, and the second diameter D2 is greater than the first diameter D1. According to a further embodiment, the first roller 210 is rotated at a first speed, the second roller 220 is rotated at a second speed, and the second speed is greater than the first speed. According to certain non-limiting embodiments, the first speed and the second speed may each be variable.

While the embodiment of the present disclosure illustrated in FIG. 4 shows five artificial eyelashes disposed on the first roller 210 of the apparatus 200, any number of artificial eyelashes may be disposed on the apparatus 200. Tapering single strands of artificial eyelashes can be time-consuming, cumbersome, and inefficient. Disposing a multitude of eyelashes E on the first roller 210 of the apparatus 200 can make tapering the eyelashes E efficient and user-friendly to the operator of the apparatus 200.

In operation, a tape or adhesive (not shown) having low tackiness is applied at the proximal end of the artificial eyelashes E for temporary adhesion of the artificial eyelashes E to the reduced diameter portion 330. According to the illustrated embodiment, the artificial eyelashes E define a concave arc lying in a section plane that is coplanar with the first rotational axis 280. The first and second rollers 210, 220 are rotated so that the outer surface 230 of the second roller 220 engages the artificial eyelashes E along the concave arc in a direction from the proximal portion 260 to the distal portion 270. This way, the distal portion 270 of the artificial eyelashes E are engaged by the outer surface 230 of the second roller 220 for a longer duration compared to the proximal portion 260, and the artificial eyelashes E are thereby tapered from the proximal portion 260 to the distal portion 270.

It may be possible to utilize any adhesive between the artificial eyelashes E and the first roller 210, provided that the adhesive does not unacceptably damage the artificial eyelashes E when the artificial eyelashes E are removed from the first roller 210 after the tapering process. The methods and apparatuses described herein are not limited in this regard. Specifically, any shape, configuration or number of adhesive layers may be used that achieve the object of the present disclosure.

While the invention has been shown and described with reference to certain embodiments thereof, it will be understood by those skilled in the art that various changes in form and detail may be made therein without departing from the spirit and scope of the invention as defined by the appended claims and their equivalents.

The invention claimed is:

1. A method of tapering artificial eyelashes, the method comprising:

coupling the artificial eyelashes to a first roller that is generally cylindrical; and while rotating the first roller to which the artificial eyelashes are coupled, rotatably engaging at least a portion of the artificial eyelashes with an outer surface of a second roller.

2. The method of claim 1, wherein a friction element is coupled to the outer surface of the second roller.

3. The method of claim 1, wherein the second roller is spaced apart from at least a portion of the first roller.

4. The method of claim 1, wherein the artificial eyelashes comprise strands selected from the group consisting of human hair, animal hair, synthetic fibers and combinations thereof.

5. The method of claim 1, wherein the first roller and the second roller are rotated in the same direction during the rotatable engagement.

6. The method of claim 1, wherein the first roller is rotated along a first rotational axis, the second roller is rotated along a second rotational axis, and the first rotational axis is substantially parallel with the second rotational axis.

7. The method of claim 1, wherein the first roller comprises at least one arcuate roller surface adapted to receive the eyelashes.

8. The method of claim 7, wherein the first roller comprises a plurality of arcuate roller surfaces, and at least two of the arcuate roller surfaces are connected to each other through a mediate cylindrical roller surface.

9. The method of claim 1, wherein the first roller defines at least one reduced diameter portion, and the artificial eyelashes are coupled to the reduced diameter portion.

10. The method of claim 1, wherein the first roller has a first diameter, the second roller has a second diameter, and the second diameter is greater than the first diameter.

11. The method of claim 1, wherein, during the rotatable engagement, the first roller is rotated at a first speed, and the second roller is rotated at a second speed, and wherein the second speed is greater than the first speed.

12. The method of claim 1, wherein the artificial eyelashes are coupled along a circumferential edge of the first roller.

13. The method of claim 7, wherein the at least one arcuate roller surface that is adapted to receive the eyelashes has a curvature that curves inward toward a center of the first roller.

* * * * *